US008746797B2

(12) United States Patent
Figueras Mitjans

(10) Patent No.: US 8,746,797 B2
(45) Date of Patent: Jun. 10, 2014

(54) AUTOMATIC ROTATION SYSTEM FOR TILTING SEATS OF CHAIRS OR ARMCHAIRS

(75) Inventor: Jose Figueras Mitjans, Llica d'Amunt (ES)

(73) Assignee: Figueras International Seating, S.L., Llica d'Amunt (Barcelona) (ES)

( * ) Notice: Subject to any disclaimer, the term of this patent is extended or adjusted under 35 U.S.C. 154(b) by 740 days.

(21) Appl. No.: 12/922,355

(22) PCT Filed: Mar. 13, 2009

(86) PCT No.: PCT/ES2009/000140
§ 371 (c)(1),
(2), (4) Date: Sep. 13, 2010

(87) PCT Pub. No.: WO2009/112620
PCT Pub. Date: Sep. 17, 2009

(65) Prior Publication Data

US 2011/0012410 A1 Jan. 20, 2011

(30) Foreign Application Priority Data

Mar. 13, 2008 (ES) ..... 200800735

(51) Int. Cl.
*B60N 2/02* (2006.01)

(52) U.S. Cl.
USPC ..... 297/374; 297/361.1; 297/354.12; 297/354.1; 297/364; 192/223.2; 192/223.3; 192/223.4

(58) Field of Classification Search
USPC ..... 297/374, 361.1, 354.12, 354.1, 364; 192/223.2, 223.3, 223.4
See application file for complete search history.

(56) References Cited

U.S. PATENT DOCUMENTS

| | | | | |
|---|---|---|---|---|
| 3,098,677 | A * | 7/1963 | Williams | 16/289 |
| 4,070,058 | A * | 1/1978 | Muehling | 297/374 |
| 4,571,773 | A * | 2/1986 | Yuda | 16/85 |
| 4,618,039 | A * | 10/1986 | Omata | 188/268 |
| 4,893,522 | A * | 1/1990 | Arakawa | 464/180 |
| 5,257,852 | A | 11/1993 | Tsuneki et al. | |
| 5,718,309 | A * | 2/1998 | Kariya | 188/290 |
| 5,794,479 | A * | 8/1998 | Schwarzbich | 74/143 |
| 6,945,600 | B2 * | 9/2005 | Liu | 297/284.4 |
| 7,296,664 | B2 * | 11/2007 | Ohta et al. | 188/294 |
| 7,938,238 | B2 * | 5/2011 | Koizumi et al. | 188/322.5 |
| 8,016,357 | B2 * | 9/2011 | Figueras Mitjans | 297/374 |
| 2002/0179387 | A1 * | 12/2002 | Orita | 188/290 |

(Continued)

FOREIGN PATENT DOCUMENTS

| | | |
|---|---|---|
| GB | 224687 Y | 11/1924 |
| WO | 2006/029473 | 3/2006 |

*Primary Examiner* — Laurie Cranmer
(74) *Attorney, Agent, or Firm* — Lucas & Mercanti, LLP

(57) ABSTRACT

The invention relates to improvements in the object of patent P200603269 for "Automatic rotation system for tilting seats of chairs or armchairs", comprising rotation supports formed by two parts (1 and 2) which are rotating in relation to one another, between which there is incorporated a rotating draw-spring (4), one of the parts (2) of each rotating support determining an annular channel (5), in which there is housed a ring (6) together with a high-viscosity silicone filler, such that said ring (6) is linked by pulling with the other part (1) of the rotating support, a braking action occurring on the rotation movement between the two parts (1 and 2) due to the friction of that ring (6) with the silicone in the channel (5).

2 Claims, 7 Drawing Sheets

(56) References Cited

U.S. PATENT DOCUMENTS

2003/0183039 A1* 10/2003 Ohta et al. ..... 74/574
2004/0045398 A1* 3/2004 Hayashi ..... 74/574
2005/0045439 A1* 3/2005 Nishiyama ..... 188/290
2006/0207844 A1 9/2006 Koizumi et al.
2009/0064455 A1* 3/2009 Cultraro ..... 16/84

* cited by examiner

AUTOMATIC ROTATION SYSTEM FOR TILTING SEATS OF CHAIRS OR ARMCHAIRS

This is a National phase of PCT/ES2009/000140 filed Mar. 13, 2009, which claims the priority of Spanish application P200800735 filed Mar. 13, 2008, all applications are incorporated by reference herein.

FIELD OF THE ART

The present invention relates to the chairs or armchairs having a seat which can be tilted between a lowered use position and a raised folded position, proposing several improvements in the automatic rotation system for the tilting of the mentioned seats described in patent P200603269, such that a functionally more advantageous embodiment is obtained for that application.

STATE OF THE ART

There are chairs and armchairs the seat of which is arranged in a rotation assembly which allows the tilting between a lowered use position and a raised folded position, solutions being known in which said assembly of the tilting seats includes a spring acting in the direction of taking the seat to the raised folded position, which determines an automatic actuation for raising the seat to said raised folded position when it is vacated.

Conventional solutions of said automatic arrangement for actuating the tilting seats towards the raised folded position include a torsion spring which is arranged tensed between respective parts of the rotating assembly of the seat which can rotate in relation to one another.

This rotation arrangement of the seats with a tensed torsion spring has the drawback that the action of the spring is completely free and causes the tilting movement of the seat with acceleration in the raising, which gives rise to an abrupt blow occurring when the seat reaches the stop of the raised position, causing noise and, with successive actuations, misalignments of the assembly.

To solve that problem, patent P200603269 discloses a system for the assembly of tilting seats with rotation supports formed by two complementary associated parts with rotational movement between them, with stops for limiting the rotation in a determined angular path, there being arranged between those two component parts of the mentioned rotation supports a coil spring mounted on a drum-shaped conformation of one of the parts of the rotation support, such that said spring exerts an action of pressure and friction on the drum-shaped conformation, determining a braking which makes the seat be raised without acceleration, but rather, on the contrary, progressively reducing the speed of the raising movement.

With this solution, the abrupt blow of the seats in their tilting to the raised position is prevented, but the movement of the seat in the raising path is slow since the reduction of the speed is progressive from the start to the end of said path.

There are, on the other hand, solutions of rotation supports including a viscous product, such as silicone, between the associated parts with relative rotation with respect to one another which form the rotating supports, such that the viscous product determines a braking between the two parts of the support, making the rotation movement between them be uniform, without acceleration.

This solution also prevents the abrupt blow of the seats in the raising stop, but the tilting movement of the seat is slow and, furthermore, with the conventional assemblies of these solutions there is the problem of losses due to leakages, which makes the braking systems lose its effectiveness.

OBJECT OF THE INVENTION

According to the present invention, improvements are proposed which combine the solution of the braking and draw-spring proposed by patent P200603269 with the inclusion of a viscous product between the component parts of the rotation supports of the tilting seats, achieving functional features which determine an action for automatically raising the tilting seats in more advantageous conditions.

According to this invention, the automatic rotation supports of the tilting seats are made up of two complementary associated parts with rotational movement between them, with stops for limiting the rotation in a determined angular path, there being included between those two component parts a coil spring arranged in a drawing assembly and mounted on a drum-shaped part which is fixed inside one of the component parts of the corresponding rotation support.

An arrangement is thus obtaining in which the draw-spring exerts a rotational force between the two component parts of the rotation support, causing the actuation for automatically raising the seat of application, but such that at the same time said spring exerts a braking on the rotation action, as a result of the friction of its coils on the drum-shaped part and because of the pressure it exerts on said part due to the tension.

Between the drum-shaped part on which the rotation-actuating spring and the corresponding outer part of that part of the rotation support are incorporated, there is determined an annular channel, in which a ring and a high-viscosity silicone filler are included, said ring being linked in a rotating association with the other component part of the rotation support.

An assembly is thus obtained in which, when the two component parts of the rotation support rotate in relation to one another, the ring which is housed in the annular channel together with the silicone exerts a braking effect due to the friction with the silicone, determining a retention which, in the application of the tilting seats, prevents the acceleration in the automatic raising of said seats due to the action of the actuating spring.

The rotating association link between the braking ring and the actuating component part of the rotation support is established by means of a projecting rod of the actuating part, and an elongated groove of the ring, in which the mentioned rod is fitted.

The rotating actuation of the ring due to the action of the actuating part thereby has an inoperative path corresponding to the shifting of the rod of the actuating part through the groove of the ring, such that in the application of the tilting seats the braking of the titling movement of said seats only occurs after the mentioned inoperative path, whereby the tilting of the seat, both in the raising and in the lowering, has an initial fast movement path and a final slow movement path due to the braking.

The arrangement of the braking ring in the annular housing channel together with the silicone is established with closure in the edges by means of O-rings to prevent the leakage of the silicone, while the walls of the annular housing channel determine striae keeping the ring centered in the channel, said striae forming, in the proximity of the ends of the angular path of the rotating pulling rod of the ring, two groups of transverse striae in the form of teeth, which perform a friction like scrapers on the faces of the ring, preventing the leakage of the silicone through those areas.

With such arrangement, the rotation support combines the action of the actuation and braking of the draw-spring between the two component rotating parts with the braking action due to the silicone at the end part of the paths of the rotating movement between the parts, such that in the application of the tilting seats, the tilting movements thereof occur with a fast movement in the beginning and with a slow movement in the end, preventing the abrupt blow in the end stop of the paths, and with an arrangement which effectively prevents the loss of silicone, the effectiveness of the operation therefore remaining unalterable.

The improvements of the invention therefore determine an embodiment which has truly advantageous features, this embodiment acquiring its own identity and a preferred character for the function of the rotation of the tilting seats with automatic raising, compared to the solutions used up until now for said function.

DETAILED DESCRIPTION OF THE INVENTION

Figure 1:
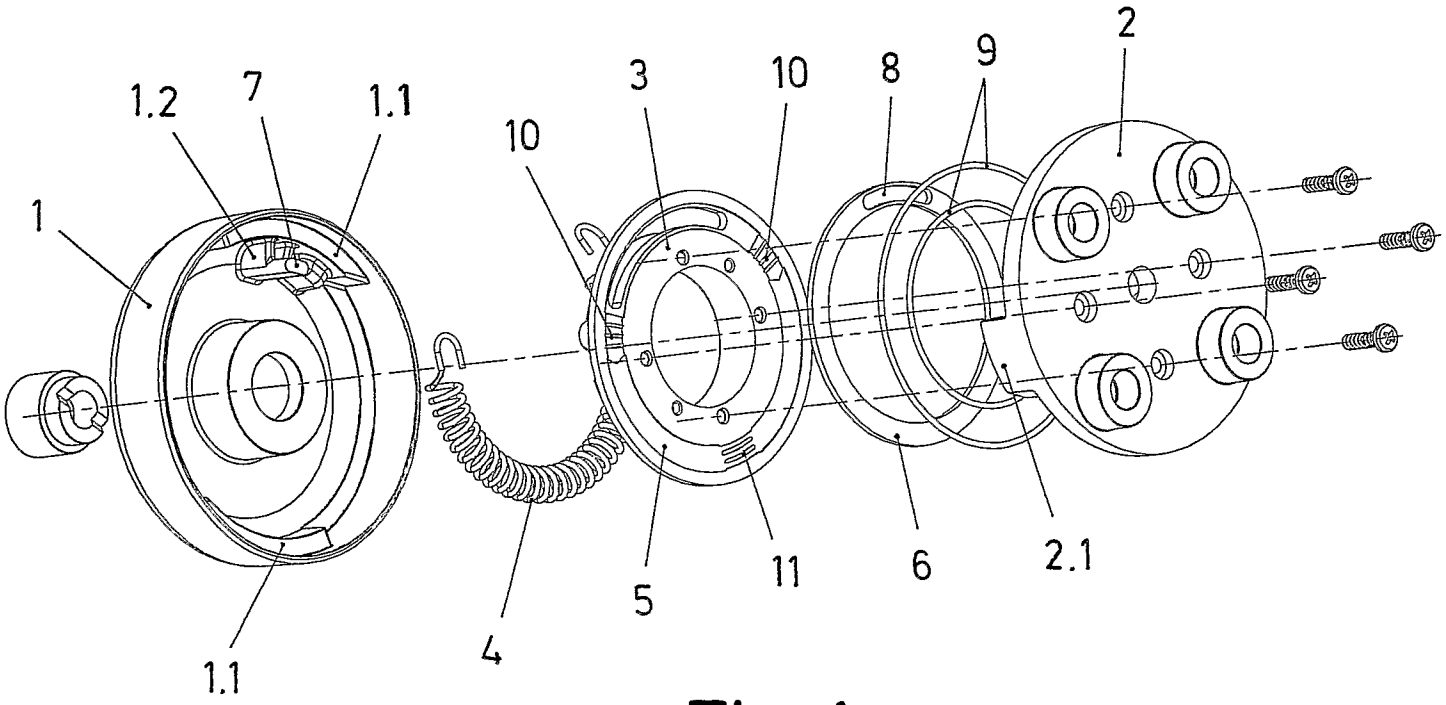
FIG. 1 shows an exploded perspective view of an embodiment of a rotation support for tilting seats, according to the invention.
Figure 2:
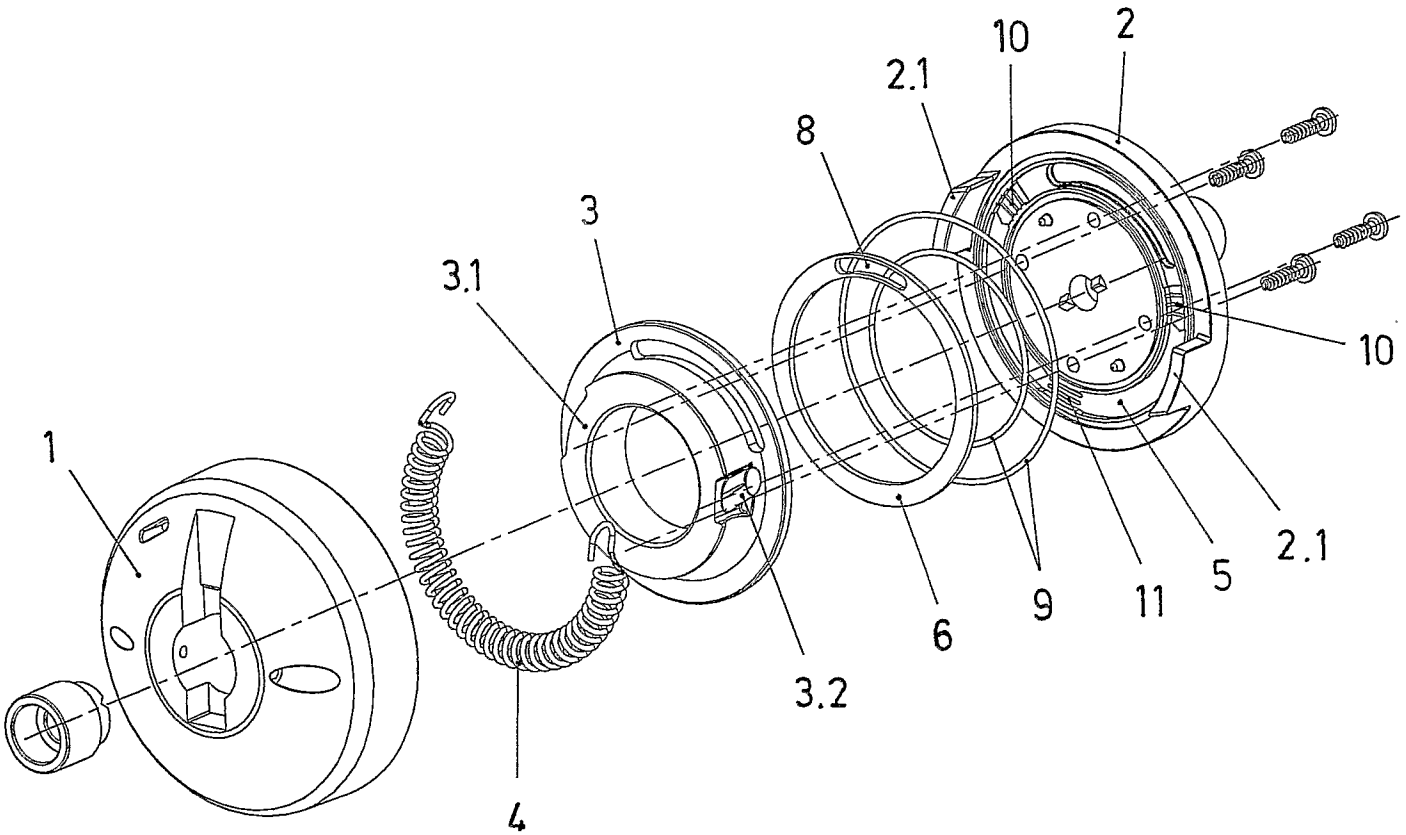
FIG. 2 is an exploded perspective view of the same rotation support of the previous figure, from another angle of observation.
Figure 3:
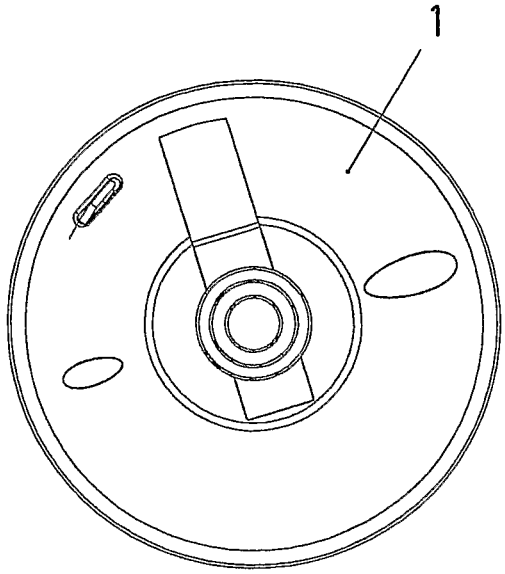
FIG. 3 is a front view of the rotation support at the part of coupling to the seat of application, in an end position of the rotation.
Figure 4:
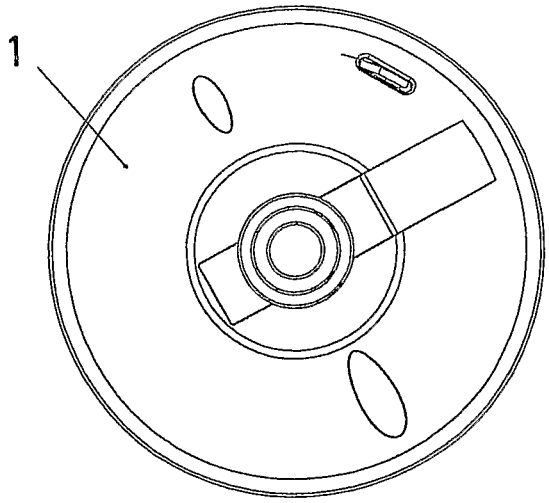
FIG. 4 is a view like that of the previous figure, in the other end position of the rotation between the parts of the rotation support.
Figure 5:
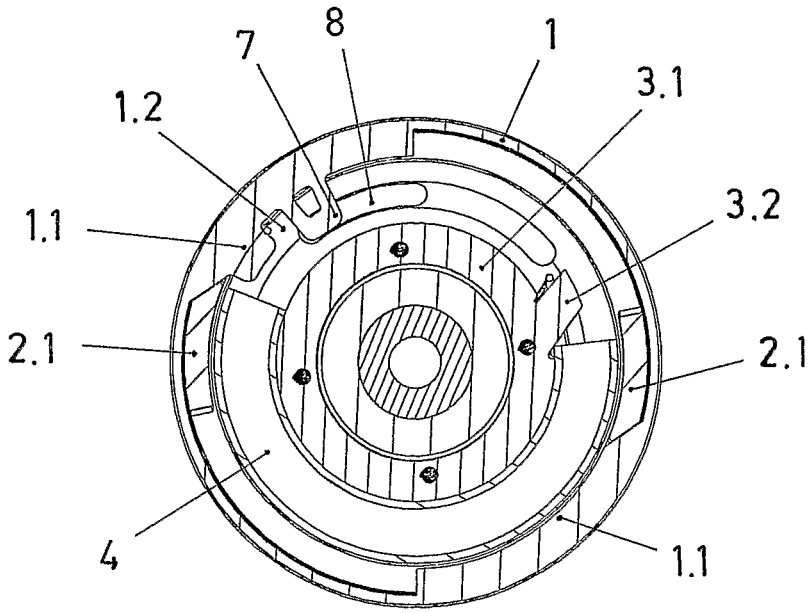
FIG. 5 is a view of the rotation support, according to a section perpendicular to the axis thereof through the area in which the spring for actuating the rotation between the component parts is located, in the position of FIG. 3.
Figure 6:
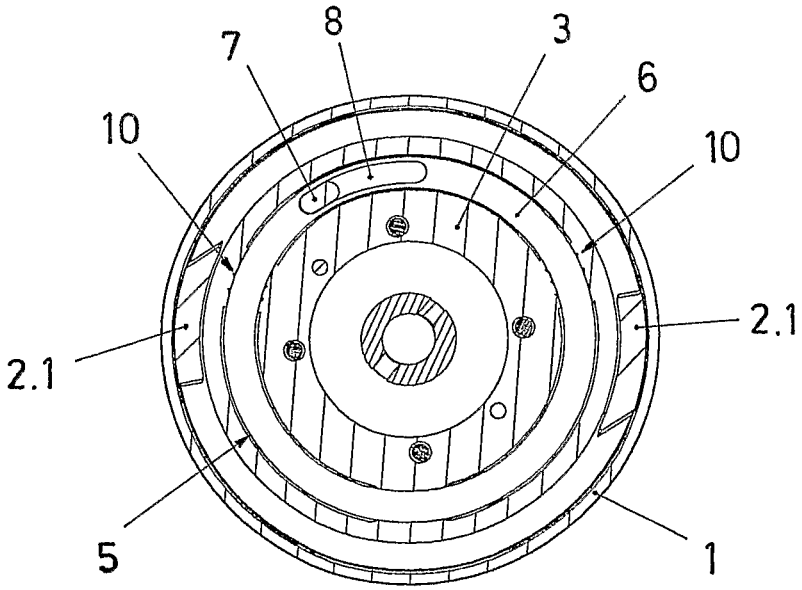
FIG. 6 is a view of the rotation support, according to a section perpendicular to the axis thereof through the area in which the braking ring for braking by silicone is located, in the position of FIG. 3.
Figure 7:
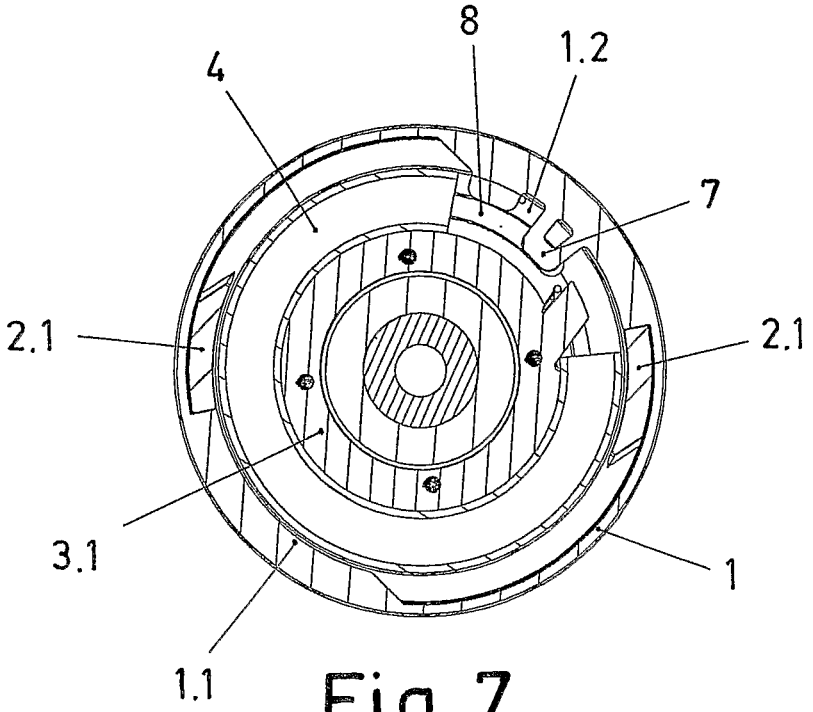
FIG. 7 is a view according to the section of FIG. 5, in the position of FIG. 4.
Figure 8:
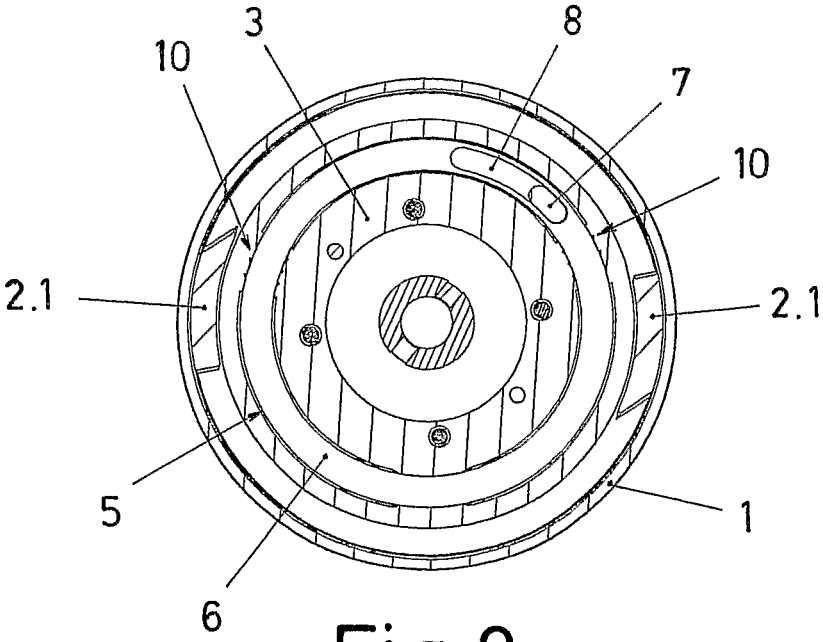
FIG. 8 is a view according to the section of FIG. 6, in the position of FIG. 4.
Figure 9:
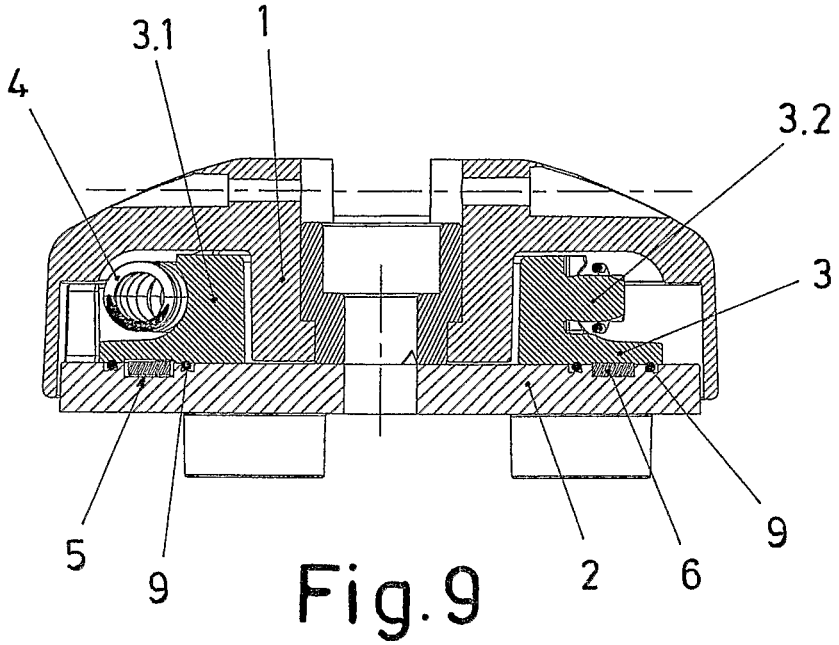
FIG. 9 is a view of the rotation support according to a diametric section.
Figure 10:
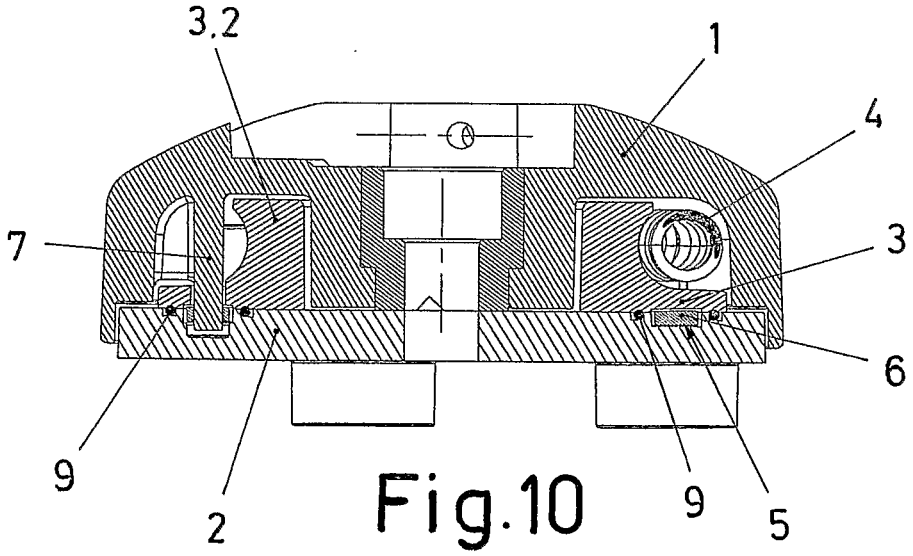
FIG. 10 is a view of the rotation support according to a diametric section through a plane different from that of the previous figure.
Figure 11:
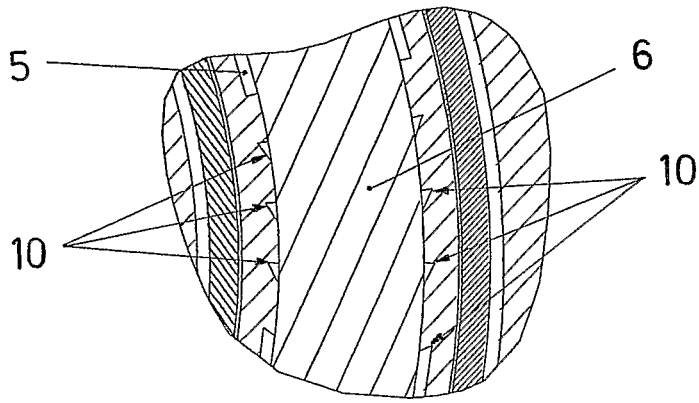
FIG. 11 is an enlarged detail in a front view of one of the toothed areas for retaining the silicone in the housing of the rotating ring.
Figure 12:
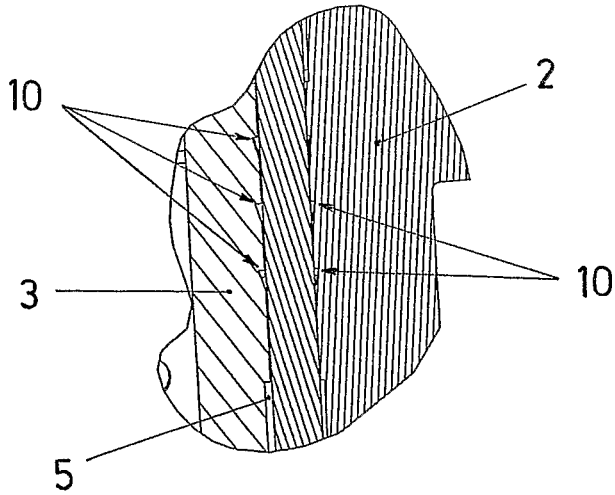
FIG. 12 is an enlarged detail in a side view of the area of the previous figure.

The object of the invention relates to improvements with which an embodiment is obtained which improves the functionality of the system proposed by patent P200603269, for application in the assembly of tilting seats of chairs or armchairs with automatic raising.

The assembly of the tilting seats of application of the system which the invention relates to is established by means of rotation supports comprising two complementary parts (1 and 2), one of which is intended to be fixed to the seat of application, whereas the other one is fixed on the structure of the corresponding chair or armchair.

Said parts (1 and 2) are coupled in an assembly with rotational movement between them, with stops (1.1 and 2.1) establishing a limitation of the rotation in a determined angular path, a part (3) being incorporated attached on the inside of one of the parts, for example the part (2), which part (3) determines a protruding drum-shaped conformation (3.1) in axial projection.

A coil type spring (4) is incorporated between the parts (1 and 2), which spring is mounted on the conformation (3.1) of the part (3), said spring (4) being hooked at its ends with tension between respective conformations (1.2 and 3.2) belonging, respectively, to the part (1) of the rotation support and to the part (3) which is attached to the part (2).

There is thus an arrangement in which the spring (4) determines a tension which makes the parts (1 and 2) tend towards one of the limit positions of the angular rotation between them, said spring (4) exerting pressure on the area of support on the conformation (3.1), such that when the parts (1 and 2) rotate in relation to one another, as a result of that support of the spring (4) on the conformation (3.1), there is a braking effect on the rotation, due to the pressure and to the friction exerted by the spring (4) itself on the surface of the mentioned conformation (3.1).

Between the part (3) and the part (2) to which said part (3) is attached, there is determined an annular channel (5), in which there is included a ring (6) which has freedom of rotational movement inside said annular channel (5).

A high-viscosity silicone filler is furthermore included in the annular channel (5), such that the ring (6) is embedded in said silicone filler, whereby the rotational movement of the mentioned ring (6) is braked due to the friction with the silicone, the viscosity of which it must overcome.

The ring (6) is linked with the component part (1) of the rotation support by means of a rod (7) emerging from said part (1) and fitted in a groove (8) of the ring (6), such that when the part (1) rotates with respect to the part (2), the rod (7) pulls the ring (6), whereby the latter in turn rotates with respect to the part (2), inside the channel (5), in which movement said ring (6) is braked due to the viscosity of the silicone filling the channel (5), and consequently the relative movement between the parts (1 and 2) is braked with a retention which makes the movement smoother.

The groove (8) of the ring (6) is elongated, such that the pulling action of the rod (7) is only effective when said rod (7) acts on the ends of the mentioned groove (8), whereby the rotation movements between the parts (1 and 2) occur with a first path without a braking effect by the ring (6), in the segment corresponding to the shifting of the rod (7) through the groove (8), and with a final braked path, in the segment corresponding to the movement with the pulling of the ring (6), from the moment in which the rod (7) abuts the end of the groove (8).

Thus, in the application of the rotation support to the assembly of a tilting seat, the spring (4) exerts an action tending to tilt the seat to the raised folded position when it is vacated, but as a result of the braking effect performed by the spring (4) itself due to the friction and pressure on the conformation (3.1) of the part (3) on which it is supported, together with the braking effect which is in turn determined by the ring (6) when it is pulled by the rod (7), the tilting movements of the seat occur with an initial fast path and with a final slow path, a relatively fast movement being obtained as a whole, but with the ends of the paths being made smoother, which prevents the abrupt blow in the stop of said ends of the path.

To prevent the leakage of the silicone which is included in the annular channel (5) together with the mobile ring (6), between the part (3) and the part (2) on which said part (3) is fixed there are O-rings (9) by means of which a sealed closure is established on both sides of the annular channel (5), whereas in the proximity of the ends of the path of the rod (7) in the pulling movement of the ring (6), the walls of the annular channel (5) determine groups of transverse striae (10) in the form of teeth, which rub on the ring (6) like scrapers to prevent the latter from pulling, adhered thereto, beyond those areas, the silicone which is in the closed part of the channel (5). The striae (10) of each area can have progressive heights, whereby the action of the scraping on the ring (6) occurs accordingly in a progressive manner, thereby determining a completely effective cleaning action on the ring (6).

In another area or other areas of the annular channel (5), other striae (11) oriented in a longitudinal direction are laterally provided to keep the ring (6) centered in said channel (5), so that the filler silicone effectively performs the braking function with respect to said ring (6).

The invention claimed is:

1. An automatic rotation system for tilting seats of chairs or armchairs, comprising:

a first complementary part and a second complementary part, the two complementary parts associated with rotational movement in relation to one another, each complementary part having a stop for limiting a rotation in a predetermined angular path;

a third part, placed between the first and second complementary parts;

an annular channel facing the second complementary part and attached on an inside of the second complementary part;

a coil spring mounted on the third part on a side facing the first complementary part, the spring being hooked at its ends;

a ring and a high-viscosity silicon filler housed in the annular channel, the ring having a groove and freedom of rotation movement inside the annular channel against the viscosity of the filler silicon;

wherein:

the groove of the ring is linked with the first complementary part by means of a pulling rod emerging from the first complementary part and fitted in the groove of the ring, the groove determining an elongated configuration in a longitudinal direction of the ring, such that during actuation of the rotation of the first complementary part, the first complementary part has an inoperative path on the ring during shifting of the rod through the groove and a path with a pulling action of the ring when the rod pushes on the end of the groove.

2. The automatic rotation system for tilting seats of chairs or armchairs according to claim 1, wherein sealing O-rings are included between the third part and the second complementary part on sides of the annular channel, such that in the proximity of an end area of a path for actuating the rotation of the ring by means of the rod, the annular channel comprising a group of striae in the form of teeth, which rub on the ring like scrapers, preventing leakage of silicone adhered thereto.

* * * * *